United States Patent [19]

Harder

[11] Patent Number: 4,517,783

[45] Date of Patent: May 21, 1985

[54] ROOF OR WALL STRUCTURE

[75] Inventor: Sven Harder, Albertslund, Denmark

[73] Assignee: Aktieselskabet Jens Villadsens Fabriker, Herlev, Denmark

[21] Appl. No.: 380,873

[22] Filed: May 21, 1982

[30] Foreign Application Priority Data

May 26, 1981 [DK] Denmark ..... 2303/81

[51] Int. Cl.[3] ..... E04B 5/52

[52] U.S. Cl. ..... 52/481; 52/762; 52/729

[58] Field of Search ..... 52/761, 762, 779, 481, 52/537, 538, 588, 729

[56] References Cited

U.S. PATENT DOCUMENTS

| | | | |
|---|---|---|---|
| 913,412 | 2/1909 | Masker | 52/762 |
| 1,185,014 | 5/1916 | Shea | 52/762 |
| 2,376,257 | 3/1946 | Foald | 52/762 |
| 3,312,028 | 4/1967 | Schroyer | 52/588 |
| 3,608,267 | 9/1971 | Carran | 52/588 |
| 3,667,182 | 6/1972 | Stemler | 52/762 |
| 4,373,312 | 2/1983 | Kim | 52/588 |

FOREIGN PATENT DOCUMENTS

| | | | |
|---|---|---|---|
| 1509108 | 5/1969 | Fed. Rep. of Germany | 52/588 |

*Primary Examiner*—Henry E. Raduazo

*Attorney, Agent, or Firm*—Watson, Cole, Grindle & Watson

[57] ABSTRACT

In a roof or wall structure comprising ablong plates having lateral edge portions in the form of partially open cylindrical flanges and in which a flange of one plate is snap locked over a flange of an adjacent plate there is provided rigid beams having at each lateral edge a flange which flanges are snap locked to cylindrical flanges of adjacent oblong plates.

6 Claims, 4 Drawing Figures

ROOF OR WALL STRUCTURE

BACKGROUND OF THE INVENTION

This invention relates to a roof or wall structure comprising oblong plates having lateral edge portions in the form of partially open cylindrical resilient flanges and in which a flange of one plate is snap locked over a flange of an adjacent plate.

Such roof or wall structures are described in the specification of British Pat. No. 1,078,792.

As described in the above patent specification a structure, e.g. a roof structure, of the above mentioned type is ordinarily fastened to a support with fastening means comprising a flat head portion having a contour corresponding to the shape of the interior of the inner flange of a set of interconnected flanges and a fastening portion, e.g. having a hole for attaching said portion of the fastening means to a support by means of a nail or a screw.

In case the support is a rafter and lath construction, the rafters should be provided with a spacing of about 60 cm to make the construction stable. However, such wooden constructions are relatively expensive and have a heavy and clumsy appearance.

When using the above mentioned fastening means, the flat head portion thereof is introduced into the interior of the inner flange of a pair of interlocked flanges and is placed perpendicular to the longitudinal axes of said flange. It is then fixed in this position by attaching the fastening portion to the support, such as a rafter or a lath. The fastening means ordinarily have to be mounted at intervals of about 60 cm in order to make the roof structure resistant against wind forces.

The object of the invention is to eliminate or reduce the above mentioned drawbacks of the prior art roof or wall structures.

SUMMARY OF THE INVENTION

This object is achieved by the structure of the invention which structure further comprises rigid beams having at each lateral edge a flange which flanges are snap locked to the cylindrical flanges of adjacent oblong plates.

When using such beams in the structure of the above mentioned type, the span between the locations at which the structure has to be supported by and fastened to the support, such as rafters, may be considerably increased. Thus, it has been found that it suffices to support and fasten a roof structure of the invention to a support at intervals of from 250 to 300 cm, whereas the prior art roof structures of the same type as mentioned above have to be fastened to and supported by the support structure at intervals of about 60 cm.

The term "rigid beams" as used herein refers to beams which are resistant to deflection when subjected to the maximum forces encountered during the use of such structure.

The necessary rigidity, e.g. a rigidity which will permit a person to walk on a roof structure of the invention, may be obtained with a minimum of construction material by using beams having an l-profile and preferably metal beams. Such beams may be made from aluminum by extrusion. However, beams made from other materials including plastics materials, such as fibre-reinforced plastics materials, are also suitable.

The cylindrical flanges provided at opposite lateral edges of the beams may be located at the foot of the beam, at its head or anywhere between these extremes.

In a preferred embodiment of the invention each beam comprises two pairs of flanges, said pairs of flanges being located at different levels, e.g. at the foot and at the head of the beam, and oblong plates are snap locked to both pairs of flanges.

Such a structure which comprises compartments which even may be closed at their ends presents particularly advantageous heat-insulating properties.

The flanges provided at the lateral edges of the beams may be hollow flanges having a configuration similar to that of the flanges of the oblong plates. However, if desired, beams having cylindrical solid flanges which further increase the rigidity of the beams may also be used.

In another preferred embodiment of the invention the flanges of the oblong plates are snapped over the flanges of the beams from above. This embodiment is capable of resisting high pressures exerted on the upper or outer side of the structure without causing the plates to be separated from the beams. Thus, when used as a roof structure it is possible to walk on such a covering.

DESCRIPTION OF THE PREFERRED EMBODIMENTS

Figure 1:
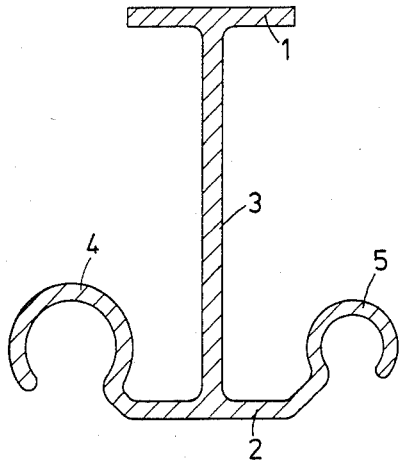
FIGS. 1–3 are cross-sectional views of three different beams for use in a roof or wall structure of the invention.
Figure 2:
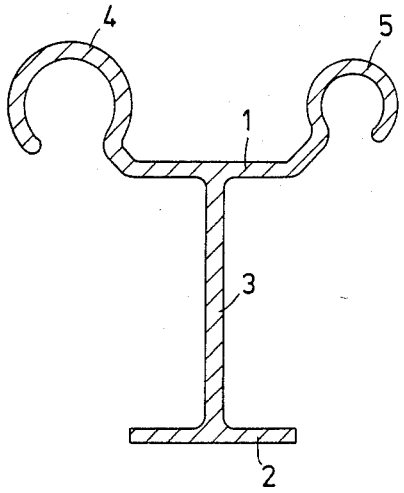
Figure 3:
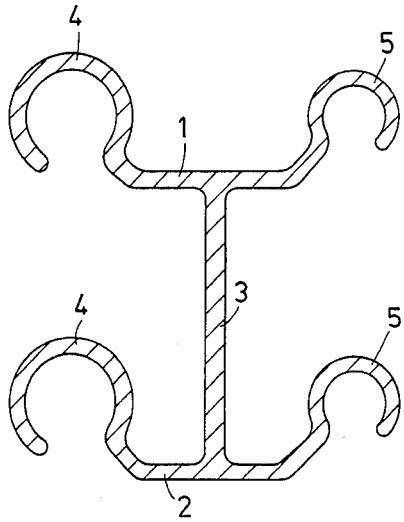

The beams illustrated in FIGS. 1–3 all have l-profile and comprise a head 1, a foot 2 and an intermediate part 3 connecting the head 1 to the foot 2. The lateral edges of the foot of the beam illustrated in FIG. 1 comprise longitudinally extending downwardly open annular flanges 4,5 having different outer diameters.

While the cylindrical flanges 4,5 are located at the foot of the beam illustrated in FIG. 1, they are located at the head of the beam illustrated in FIG. 2 and the beam illustrated in FIG. 3 comprises cylindrical flanges 4,5 located at both the head and the foot of the beam.

Figure 4:
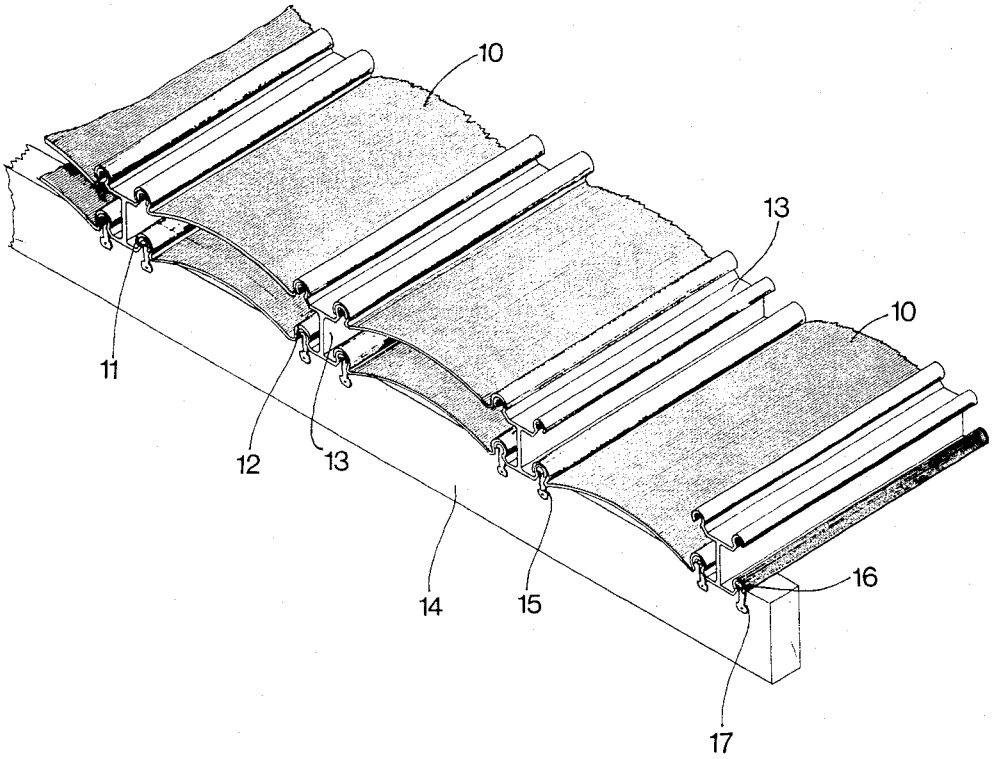
FIG. 4 is a perspective view of a roof structure comprising beams of the type illustrated in FIG. 3.

The roof structure illustrated in FIG. 4 comprises rectangular plates 10 having downwardly open cylindrical flanges 11,12 at their lateral edges. The structure illustrated further comprises beams 13 which are similar to the beam illustrated in FIG. 3. The connection between the plates 10 and the beams 13 has been obtained by snapping the flanges 11,12 of the plates 10 over the flanges 4 and 5, respectively, of the beams 13 from above so as to partially surround the latter. The structure consisting of the plates 10 and the beams 13 is attached to rafters 14 (only one has been shown in FIG. 4). The structure is attached to said rafters by fasteners 15 having a head portion 16 inserted in the lowermost flange of the beam 13 and a fastener portion 17 with a hole having inserted therein a nail or a screw which is inserted in the rafter 14.

As will appear from FIG. 4 compartments which are open only at their ends are formed when plates are snapped over both the flanges at the foot and at the top of the beams. The heat insulation properties of such a construction are excellent especially when both the plates and the beams or portions thereof are made from a material which is heat insulating per se and when the compartments are closed at their ends.

I claim:

1. A roof or wall structure, comprising a plurality of elongated plates each having lateral edge portions in the form of partially open cylindrical resilient flanges, and a plurality of elongated rigid beams disposed between adjacent ones of said plates, said beams having at each lateral edge thereof two spaced apart partially open cylindrical flanges, said flanges of said plates being snap-locked together with said flanges of said beams.

2. The structure according to claim 1, wherein said beams each have an I-shaped profile.

3. The structure according to claim 1, wherein said beams are comprised of aluminum.

4. The structure according to claim 1, wherein said beams are comprised at least partially of a plastic material.

5. The structure according to claim 1, wherein said beams are comprised of a plastic material reinforced with fibers.

6. The structure according to claim 1, wherein said flanges of said plates are snap-locked over said flanges of said beams.

* * * * *